US005908133A

United States Patent [19]

Luburic et al.

[11] Patent Number: 5,908,133

[45] **Date of Patent: *Jun. 1, 1999**

[54] CONTAINER INCORPORATING LIQUID DRAINING MEANS, AND RELATED METHOD

[75] Inventors: Frano Luburic, Costa Mesa; C. Richard Roper, Orange, both of Calif.

[73] Assignee: Ropak Corporation, Fullerton, Calif.

[ * ] Notice: This patent is subject to a terminal disclaimer.

[21] Appl. No.: 08/680,023

[22] Filed: Jul. 15, 1996

Related U.S. Application Data

[63] Continuation-in-part of application No. 08/302,597, Sep. 8, 1994, Pat. No. 5,615,798.

[51] Int. Cl.[6] ..... B65D 1/34

[52] U.S. Cl. ..... 220/572; 220/571; 220/608; 220/606; 220/627

[58] Field of Search ..... 220/608, 572, 220/625, DIG. 6, 627, 626, 571, 694, 729, 731, DIG. 21, 495.03, 495.06, 495.11, 495.01, 574.3, 1.6, 601, 919, 605, 606, 607

[56] References Cited

U.S. PATENT DOCUMENTS

| | | | |
|---|---|---|---|
| 3,405,858 | 10/1968 | Collie | 220/608 |
| 3,903,641 | 9/1975 | Hoffman et al. | 220/606 |
| 4,650,086 | 3/1987 | Morrison, Jr. | 220/606 |
| 4,880,156 | 11/1989 | Wallet . | |
| 4,932,556 | 6/1990 | Hui et al. . | |
| 5,392,945 | 2/1995 | Syrek | 220/608 |
| 5,607,709 | 3/1997 | Fritz et al. | 220/608 |
| 5,615,798 | 4/1997 | Luburic et al. | 220/608 |

FOREIGN PATENT DOCUMENTS

| | | | |
|---|---|---|---|
| 935405 | 10/1973 | Canada | 220/DIG. 6 |
| 2402599 | 5/1979 | France . | |
| 2433734 | 1/1976 | Germany . | |
| 2059920 | 4/1981 | United Kingdom | 220/608 |

*Primary Examiner*—Stephen Castellano
*Attorney, Agent, or Firm*—J. Mark Holland

[57] ABSTRACT

A container for transporting particulate matter is initially in slurry form has a base and a sidewall portion extending upwardly therefrom and is characterized by a downwardly extending, integrally-formed peripheral drainage channel having a drainage opening at a normally lowest point therein. The container bottom is configured to urge liquid from the slurry toward the channel, and the channel is configured to urge the liquid toward the drainage opening. The sidewall portion defines an opening coverable by a lid. A liner may be used to improve the drainage of the liquid from the slurry and from the container, and a plug can be placed in the drainage opening after liquid has drainage from the slurry and the container. A supplemental elevating member can be utilized to elevate the slurry with respect to the channel. A method of use of the container is disclosed.

12 Claims, 10 Drawing Sheets

24
34
22
37
20
35
40
32
28
34
36
42
38
27
36
40
34

40
22
25
46
36

15
25
22
46
36

15
44
25
32
22
40
36

13
25
22
44
40
32
36
13

CONTAINER INCORPORATING LIQUID DRAINING MEANS, AND RELATED METHOD

This is a continuation-in-part of U.S. application Ser. No. 08/302,597, filed Sep. 8, 1994 now U.S. Pat. No. 5,615,798.

BACKGROUND OF THE INVENTION

This invention relates to containers in general, and specifically to a container for particulate matter which matter is initially in slurry form. The container is especially well-suited for use in transporting and processing fish roe for human consumption.

Particulate matter such as fish roe is sometimes processed in slurry form. While aiding in certain processing steps, the slurry form eventually becomes undesirable at certain points in certain applications. Accordingly, it becomes necessary and/or desirable to drain the liquid (or some portion thereof) from the slurry. The remaining particulate matter (such as fish roe) is then further processed, transported, distributed, consumed, etc. without the liquid component (or with a reduced liquid component) of the slurry.

By way of example, present fish roe processing techniques and apparatus commonly include a container having a base portion and a sidewall portion extending upwardly therefrom when the container is in its normally upright position. The sidewall has an upper end that defines an opening. After roe is placed into the container through the opening, a lid is typically engaged with the upper end of the sidewall to cover the opening and seal the container prior to transport, storage, etc.

The roe is typically processed in a slurry form prior to being placed in the container. For various reasons, it is desirable to remove or reduce the amount of liquid from the slurry contemporaneously with placing it into the container. To that end, the base portion of such prior art containers typically includes a drainage hole, and the bottom of the container is configured to urge the liquid toward the drainage hole.

The draining function in some prior art containers is improved by placing a separate elevating member on the bottom prior to placing the roe in the container. A plastic liner is placed over the elevating member and the roe is then placed on the liner. The combination of the elevating member and the liner spaces the roe slurry from the bottom of the container, thereby permitting the liquid to drain (and to even be mechanically pressed) from the slurry and out of the container more effectively. In other words, a space is formed under the slurry to permit the liquid to drain out of the slurry onto the bottom of the container and then out the drainage hole.

Such prior art systems, while functionally effective to drain and transport the roe, have numerous shortcomings. For example, additional material and manufacturing are required to mold the elevating member that is placed into the container prior to filling it with roe. By way of further example, the assembly process is complicated by the need to assemble and maintain the separate elevating member with the rest of the container.

OBJECTS AND ADVANTAGES OF THE INVENTION

It is, therefore, an object of our invention to provide an improved container for transporting, processing and/or handling slurries such as fish roe. The container of our invention is characterized by a base portion and a sidewall portion extending upwardly therefrom when the container is in its normally upright position, in which the base portion includes a central portion and an integrally-formed sluice channel therearound. The channel is preferably configured to receive liquid from the slurry when the container is in its normally upright position, and is located at the periphery of the base portion.

Another object of our invention is the provision of a container of the aforementioned character, in which the channel and bottom portion are configured to be used in connection with prior art separate central elevating members. As indicated above, these prior art elevating members typically have a normally relatively upwardly positioned central portion and skirt means extending downwardly therefrom. To further improve the drainage function of our invention, the skirt means of the prior art elevating members is preferably engagable in the sluice channel. This increases the drainage space and differential between the bottom of the slurry and the bottom of the container and/or channel.

A further object of our invention is the provision of a container of the aforementioned character, further including a drainage opening in the channel, with the channel configured to urge the liquid toward the drainage opening. A plus member can be utilized to plug the opening after liquid has drained from the slurry and container.

Still another object of our invention is the provision of a container of the aforementioned character, in which the central portion of the base portion is configured to urge the liquid from the slurry toward the channel when the container is in its normally upright position. Preferably, a liner such as used in prior art devices can also be used in connection with the container of our invention, to further enhance the drainage function.

Among the many alternative embodiments of our invention are drainage channels at other than the periphery of the base, and/or combinations of peripheral drainage channel portions and non-peripheral portions. Likewise, the particular location or locations for drainage holes can be selected from a wide variety of positions on the base portion, but will preferably always be at the lowest point or points of the drainage channel, to help promote drainage. Although a non-peripherally located drainage hole may make the draining less complete and reliable (if the draining procedure occurs, for example, on the angled plane of a boat's deck, liquid may "collect" and not drain from that portion of the drainage channel which is downhill of the drainage hole; a peripheral drainage hole can be oriented downhill to prevent that problem), there may be applications in which a non-peripheral location provides benefits. The liner configuration may need to be modified to similarly prevent retention of liquid on top of the liner.

An additional object of our invention is the provision of a method of transporting fish roe, including the steps of providing a container of the aforementioned character, having a base portion with a roe-supporting portion and a sluice channel, the channel being formed integrally with the roe-supporting portion and configured to receive liquid from the slurry when the container is in its normally upright position; placing a slurry of fish roe into the container; sealing the container; and transporting the container. Preferably, the channel includes a drainage opening at its lowest point, and the method includes the steps of allowing liquid to drain from the slurry through the opening and subsequently plugging the opening to prevent further drainage.

Yet another object of our invention is the provision of a method of the aforementioned character, further including the step of placing a central elevating member into the container before placing the slurry of fish roe into the container to elevate the slurry with respect to the channel. As with prior art devices, a liner can also be placed in the container prior to placing the slurry of fish roe into the container, so that the liner is between the slurry and the container.

Other objects and advantages of the invention will be apparent from the following specification and the accompanying drawings, which are for the purpose of illustration only.

DESCRIPTION OF PREFERRED EMBODIMENTS

Figure 1:
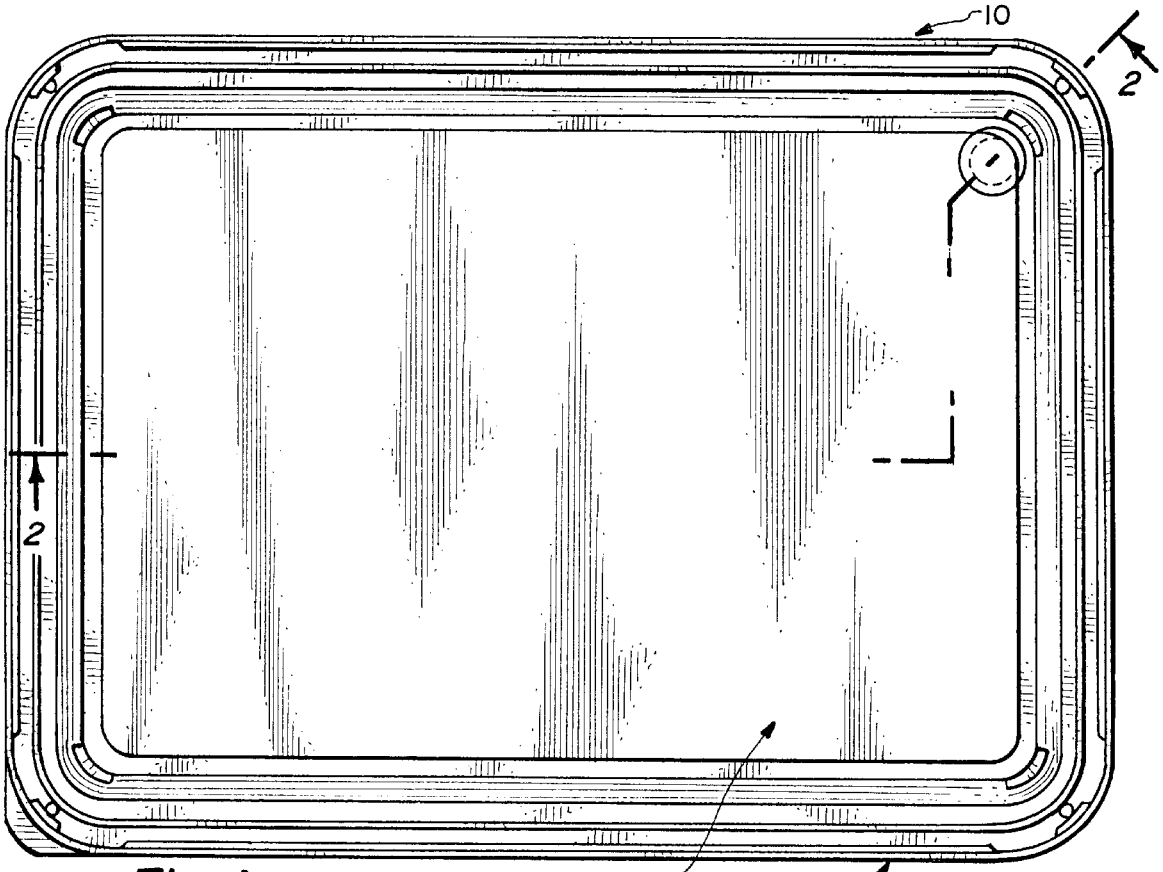
Fig. 1. PRIOR ART
FIG. 1 is a plan view of a prior art container.

Referring now to the drawings, and particularly to FIGS. 1–4 thereof, we show a typical prior art container 10 for transporting fish roe for human consumption. The container is shown without its associated lid, liner means, and plug members, but the lid, liner means, and plug members described below in relation to the present invention are similar to those usable with this prior art container.

Figure 2:
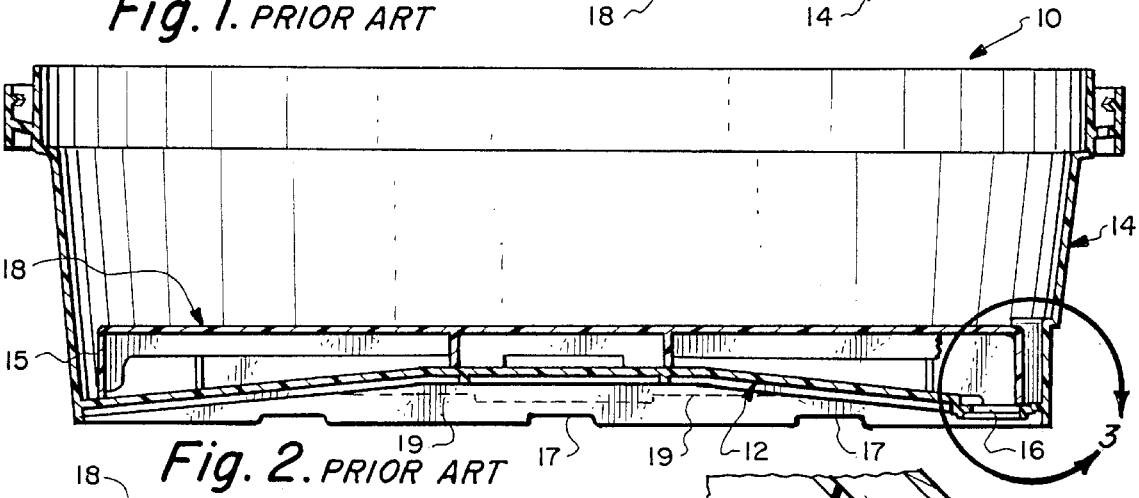
Fig. 2. PRIOR ART
FIG. 2 is a sectional view taken along line 2—2 of FIG. 1.
Figure 3:
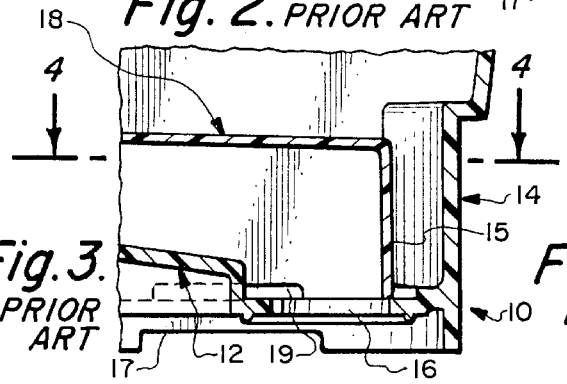
Fig. 3. PRIOR ART
FIG. 3 is a broken sectional view taken along line 3—3 of FIG. 2.
Figure 4:
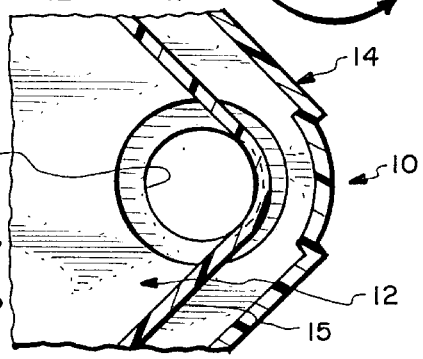
Fig. 4. PRIOR ART
FIG. 4 is a sectional view taken along line 4—4 of FIG. 3.
Figure 5:
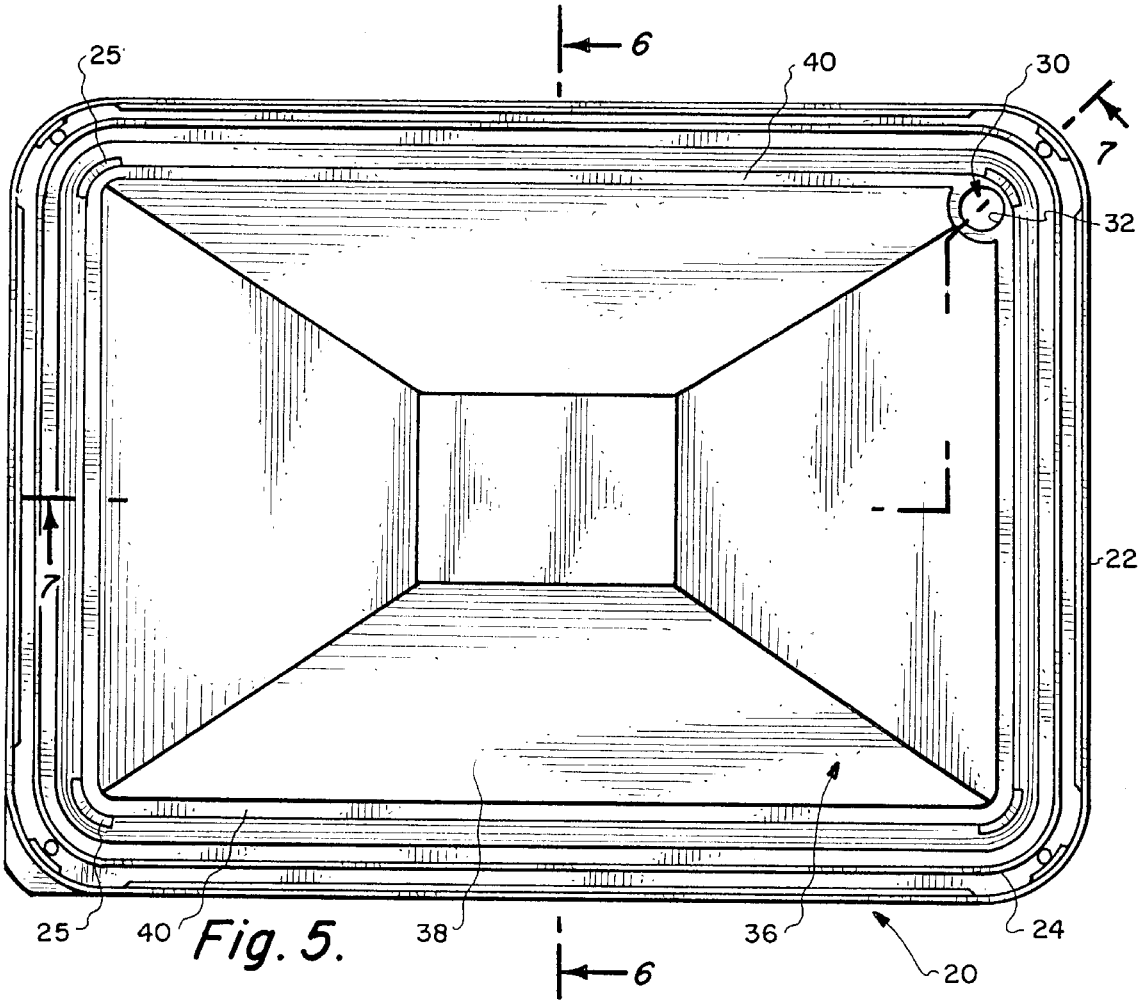
FIG. 5 is a plan view of a preferred embodiment of a container constructed and fabricated in accordance with the teachings of the invention.
Figure 6:
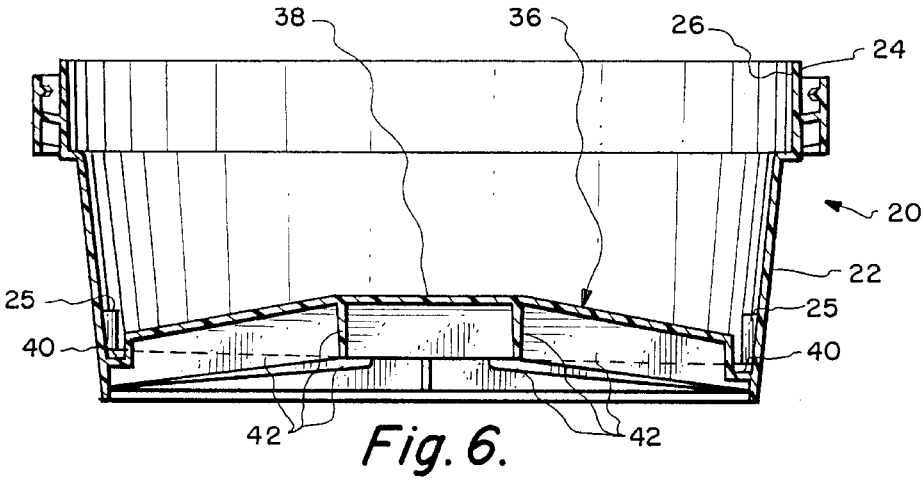
FIG. 6 is a sectional view taken along line 6—6 of FIG. 5.
Figure 7:
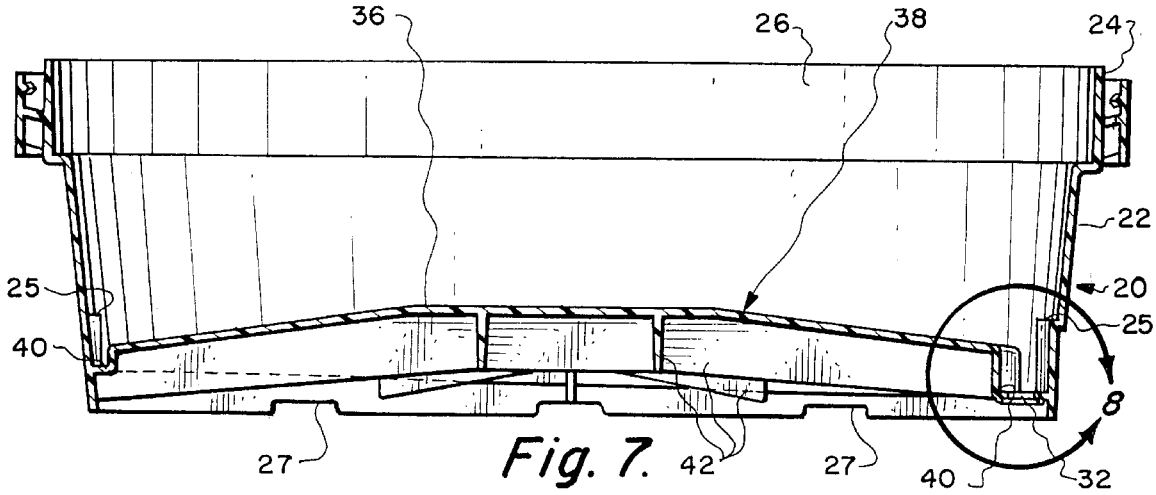
FIG. 7 is a sectional view taken along line 7—7 of FIG. 5.
Figure 8:
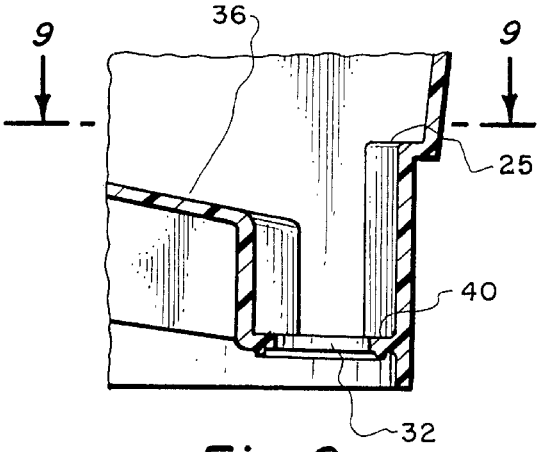
FIG. 8 is a broken sectional view taken along line 8—8 of FIG. 7.
Figure 9:
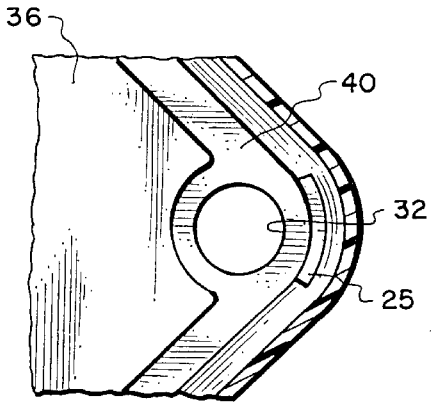
FIG. 9 is a sectional view taken along line 9—9 of FIG. 8.
Figure 16:
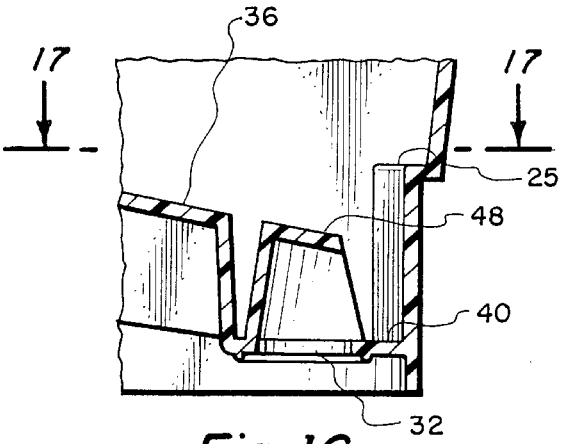
FIGS. 12, 14 and 16 are similar to FIG. 8, but illustrate some of the many alternative embodiments of the drainage means of our invention.
Figure 17:
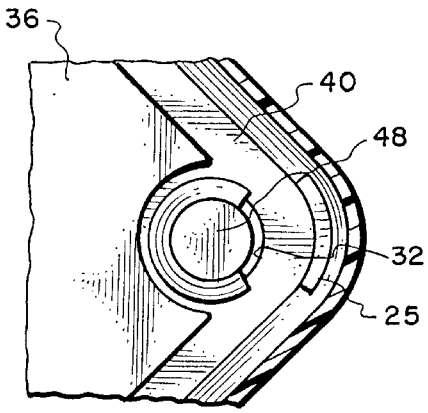
FIGS. 13, 15 and 17 are similar to FIG. 9, but are sectional views taken, respectively, along line 13—13 of FIG. 12, line 15—15 of FIG. 14, and line 17—17 of FIG. 16.
Figures 11, 12, 13, 14, 15:
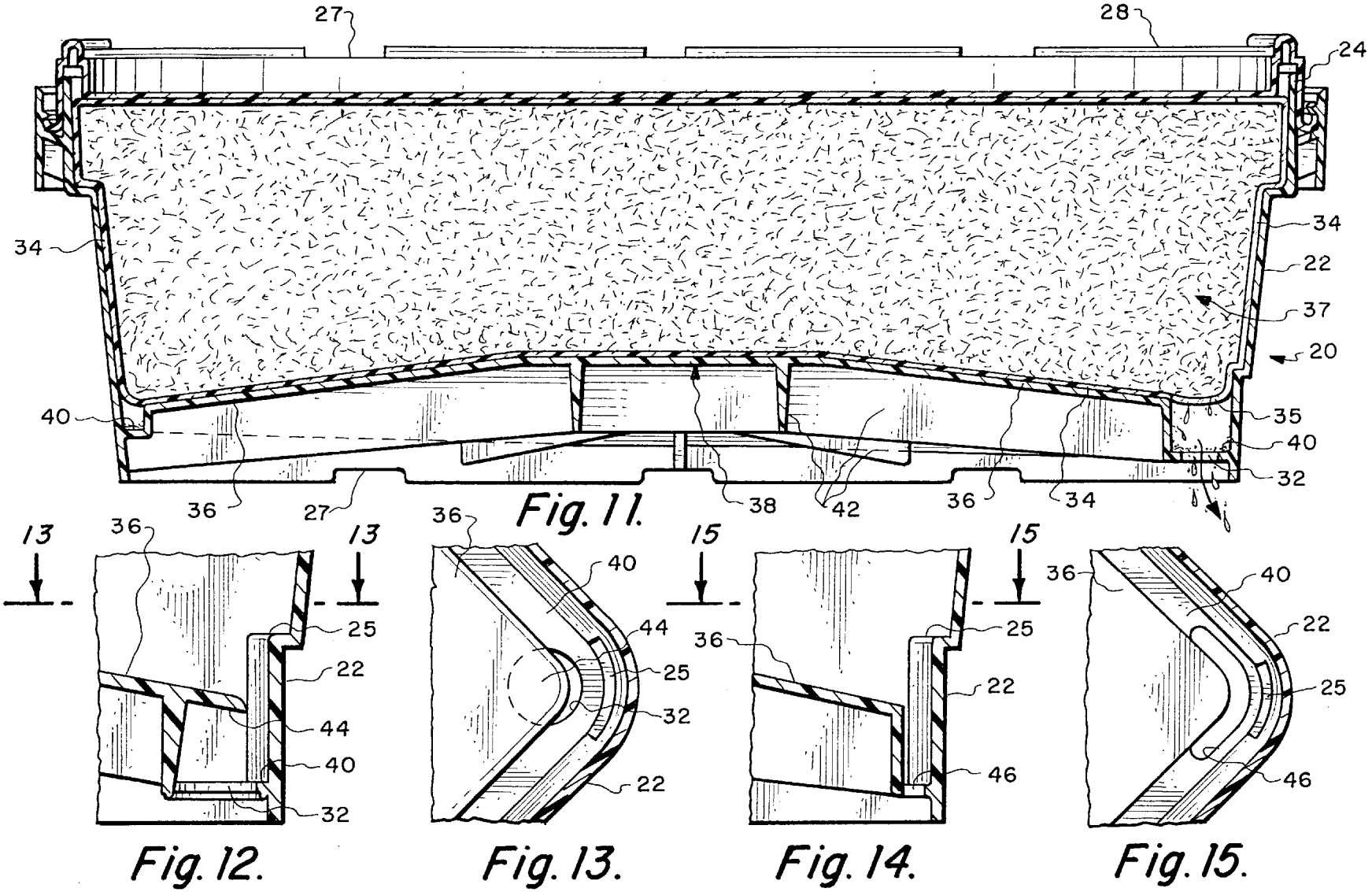
FIG. 11 is a sectional view of a preferred embodiment of a container, lid, and liner (without a plug) fabricated and assembled in accordance with the teachings of our invention, taken along a line similar to line 7—7 of FIG. 5, and illustrating liquid draining from the assembly.

The prior art container 10 is characterized by a base portion 12 and a sidewall portion 14 extending upwardly therefrom when the container is in its normally upright position (see FIGS. 2 and 3, for example). The base portion 12 includes a drainage opening 16 to permit liquid to drain from fish roe slurry (not shown) that is placed into the container. A spacer insert or elevating member 18 is typically placed on the base portion 12 prior to filling the container with roe slurry, and a liner (not shown, but see the description below regarding FIG. 11 of the present invention) is then placed onto the insert 18. The combination of the insert 18 and the liner 34 (the liner is illustrated in FIG. 11) elevates or spaces the roe slurry from the base portion 12 of the container 10, improving the drainage of liquid therefrom.

Cutback areas 19 are typically provided on a downwardly extending skirt portion 15 of the insert 18, to permit the drained liquid to flow freely between the outside and the inside of the skirt portion. Cutbacks 17 are typically provided on the lower edge of the sidewall portion 14 to facilitate molding, banding of multiple containers together, or other purposes.

The entire prior art container 10 and lid (not shown) is typically injection molding from plastic or other suitably lightweight, flexible, durable material, although other processes and materials can be used. Persons of ordinary skill in the art will understand that, as described herein, the preferred embodiment of the present invention may be fabricated from similar materials and from similar processes, as well as front other materials and processes, so long as the embodiment functions as described hereinbelow.

A preferred embodiment of the container 20 of our invention, FIGS. 5–11 and 22, incorporates many elements similar to that of the prior art device 10. For example, the container 20 includes a sidewall portion 22 having an upper edge 24 defining an opening 26 through which fish roe or other slurry of particulate matter may be inserted into the container 20. The upper edge 24 is preferably engageable with a lid member 28, FIGS. 10 and 11, so that the fish roe or other slurry can be sealed inside the container 20.

Figure 10:
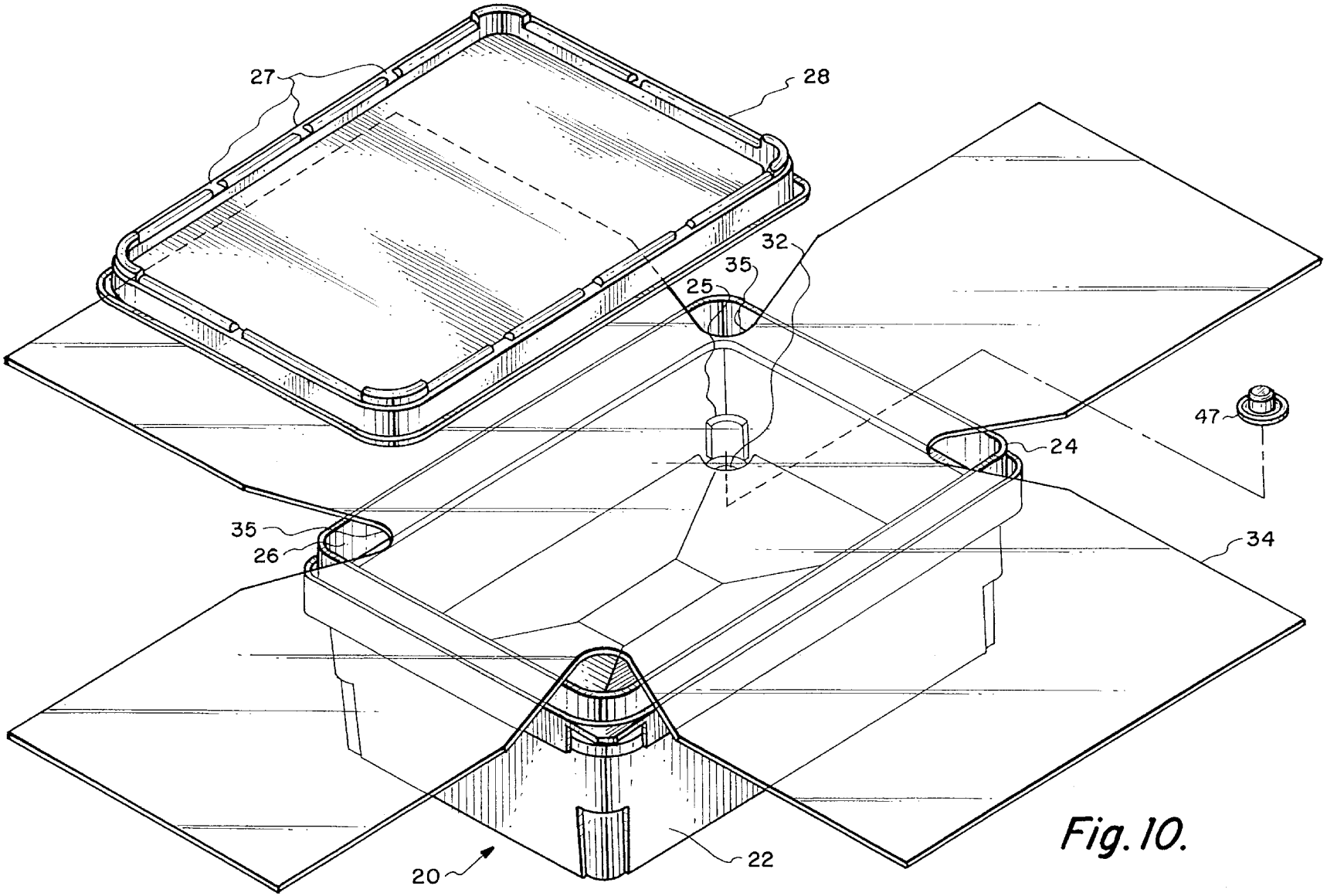
FIG. 10 is an exploded isometric view of a preferred embodiment of a container, lid, liner and plug fabricated in accordance with the teachings of our invention.

Also as with the prior art device 10, our invention preferably includes drainage means 30 such as a hole 32 to permit liquid from the slurry to drain from the container 20. Moreover, the container 20 is nestable and stackable with similarly sized and shaped containers (see shoulders 25, which are only representative of structures facilitating stacking and nesting; such shoulders can be any of a variety of shapes, sizes and configurations, and can even be absent). The container 20 also includes cutbacks 27 on the bottom edge of the sidewall portion 22 and the lid member 28, to facilitate banding of the lid to the container and/or of multiple containers together. Furthermore, a liner means 34, FIGS. 10 and 11, is preferably utilized to, among other things, help improve drainage of liquid from the particulate slurry. The liner is preferably fabricated from a clear or transparent plastic film, is of a cross-shaped configuration, and includes corner cut-outs 35 to facilitate the drainage of liquid from a slurry 37 inside the liner 34, as described hereinbelow. The outer flaps of the liner 34 can be folded over the slurry as described below and as shown in the drawings, or can hang over (not shown) the upper edge 24 of the sidewall 22.

The present invention differs from the prior art device 10 in a number of ways. The present container 20 includes a base portion 36 having an elevated central portion 38 and a sluice channel 40 therearound. The channel 40 is formed integrally with the central portion 38 and is configured to receive liquid from the slurry when the container is in its normally upright position.

Preferably, the channel 40 is at the periphery of the base portion 36. Persons of ordinary skill in the art will understand, however, that the channel could be provided in other configurations and at other locations on the container 20. A few examples of the wide variety of alternative embodiments of channel configurations are illustrated in FIGS. 23–26, as more thoroughly discussed below. Likewise, although the container 20 is illustrated as rectangular, persons of ordinary skill in the art will understand that the invention can be practiced in a wide range of other container shapes and configurations.

In the preferred embodiment 20, the base portion 36 includes integral supporting ribs 42, FIGS. 6, 7, 11 and 22, which help provide a desirable degree of strength and stability to the shape of the base portion 36. As illustrated, the central portion 38 is configured to urge the liquid from the slurry 37, FIG. 11, toward the channel 40 when the container 20 is in its normally upright position. Persons of ordinary skill in the art will understand that this improves the draining function of the container 20.

As indicated above, the preferred container 20 also includes a drainage opening 32 in the channel 40. The channel 40 is configured, and the opening 32 is located in the channel 40, to urge the liquid from the slurry toward the drainage opening. In the preferred embodiment, this is accomplished by locating the opening 32 at the relatively lowest point of the channel 40, and forming the channel so that it gradually becomes more shallow as one moves from the opening 32 around the periphery of the container 20 to a point on the opposite side of the periphery. That opposite point is, therefore, preferably the highest (or shallowest) part of the channel 40, and the liquid from the slurry therefore tends to run toward the opening 32 once the liquid enters the channel 40.

Among the many alternative embodiments of the invention are those illustrated in FIGS. 23–30, which show (among other things) drainage holes located at positions other than the periphery of tie container. Persons of ordinary skill in the art will understand that the drainage hole may be located at any suitable position on the container, and that multiple drainage holes may be provided, but always preferably located so that the drainage channels will urge the liquid toward the drainage hole or holes.

Figure 11A:
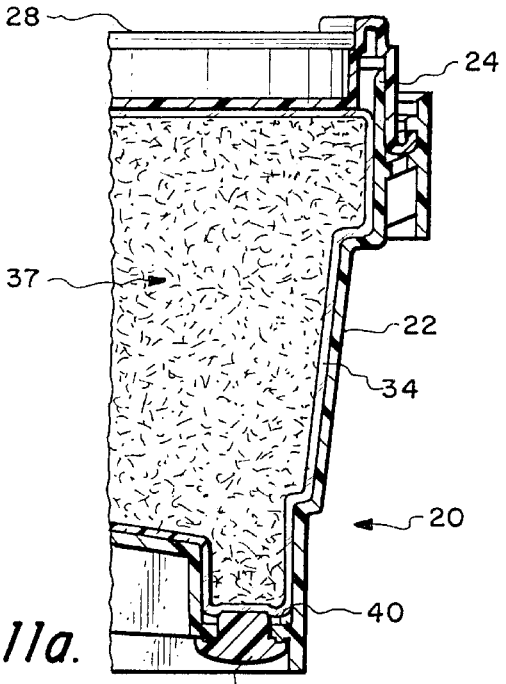
FIG. 11*a* is a broken sectional view similar to the lower right corner of FIG. 11, but illustrating an alternative assembly of the liner means of the invention, and further illustrating the plug means inserted into the drainage opening.
Figure 22:
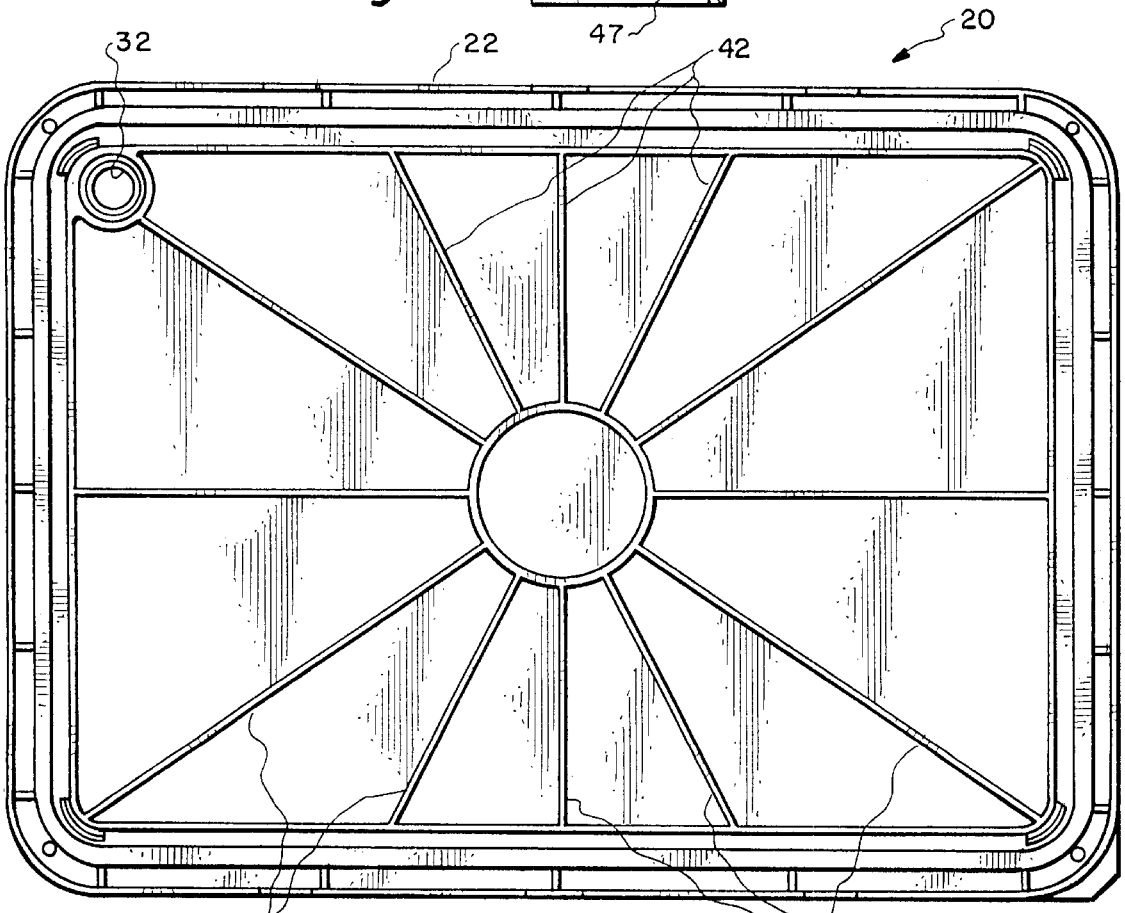
FIG. 22 is a bottom view illustrating a preferred embodiment of support ribs for the container.
Figure 18:
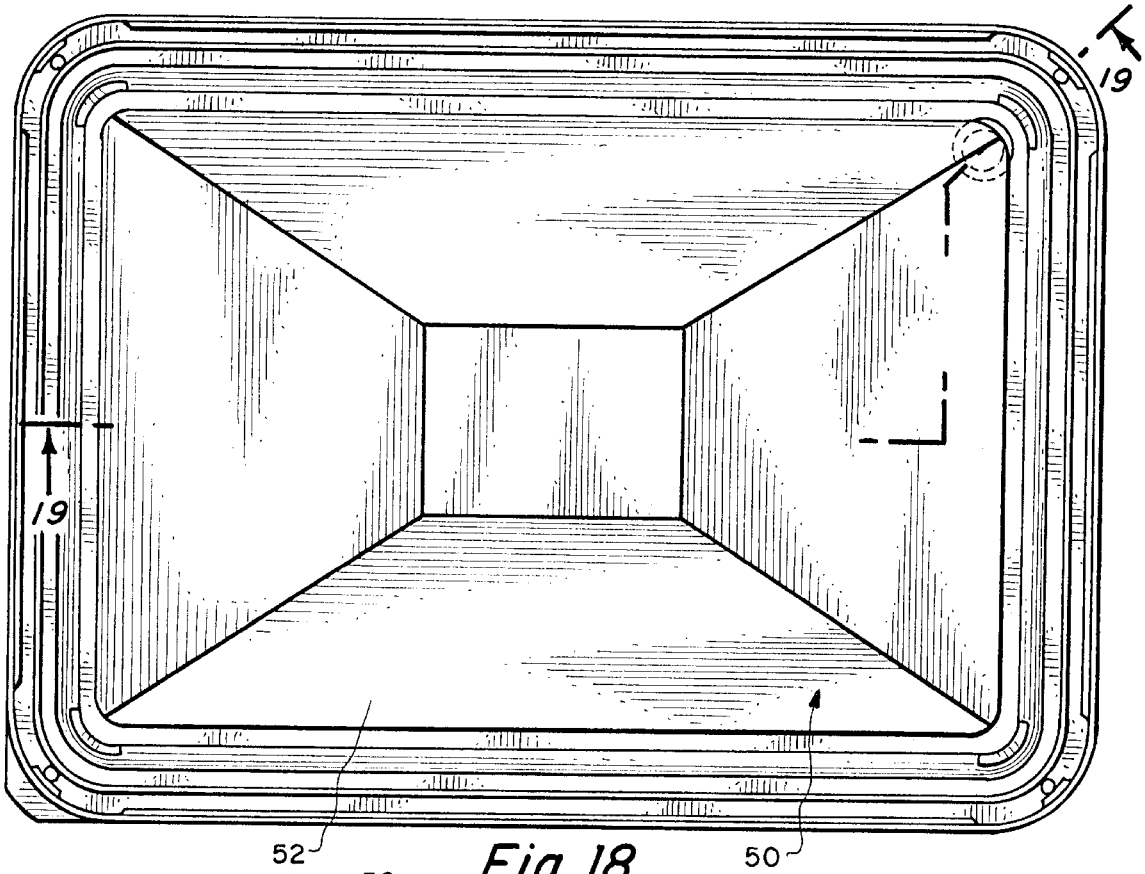
FIG. 18 is a plan view of one of the many alternative embodiments of the invention, illustrating the use of a central elevating member.
Figure 19:
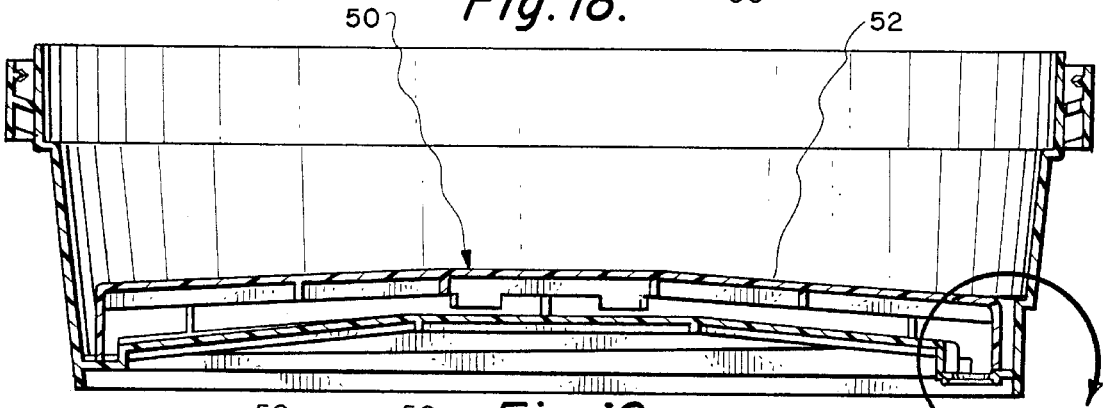
FIG. 19 is a sectional view taken along line 19—19 of FIG. 18.
Figure 20:
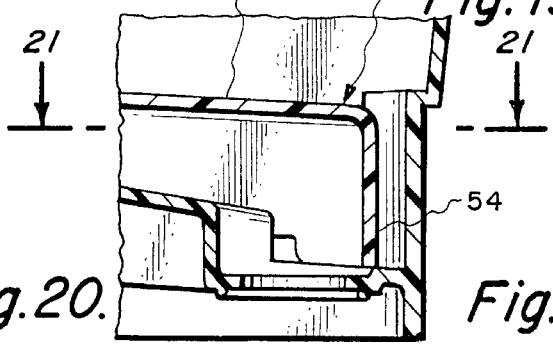
FIG. 20 is a broken sectional view taken along line 20—20 of FIG. 19.
Figure 21:
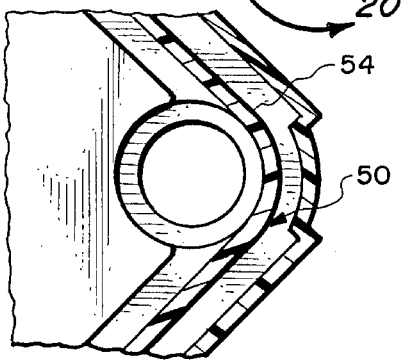
FIG. 21 is a sectional view taken along line 21—21 of FIG. 20.

The liner means can alternatively be forced into the channel 40, FIG. 11*a*. Once the liquid (or a desired amount thereof) has drained from the slurry 37 and the container 20, plug means such as a plug member 47 can be inserted into the opening 32 to prevent further drainage during subsequent transportation, storage or handling of the container 20. The plug is configured and made from any suitable material (such as rubber, etc.) so as to seal the opening 32 from further drainage and to be sufficiently retained therein.

Figure 27:
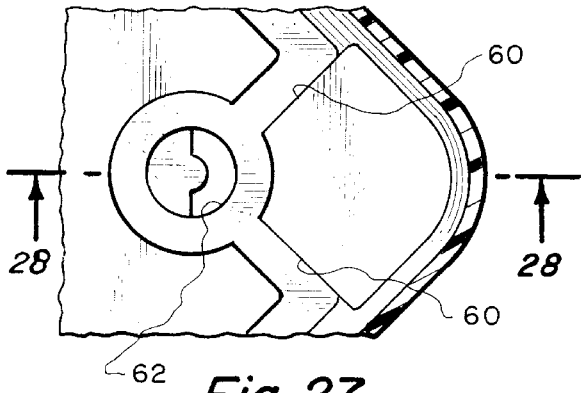
FIG. 27 is similar to FIG. 9, but illustrates one of the many alternative embodiments of the invention (showing one of the many non-peripheral locations at which the drainage hole may be positioned)
Figure 28:
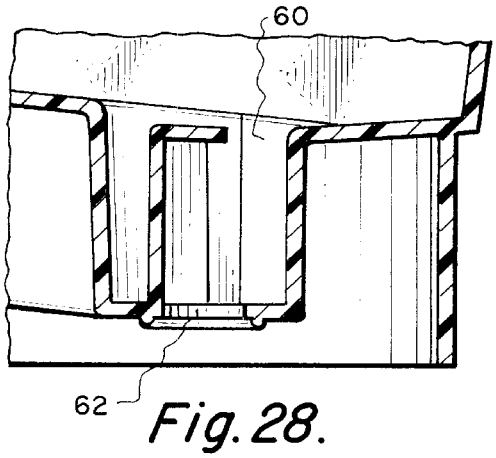
FIG. 28 is a sectional view taken along line 28—28 of FIG. 27.
Figure 29:
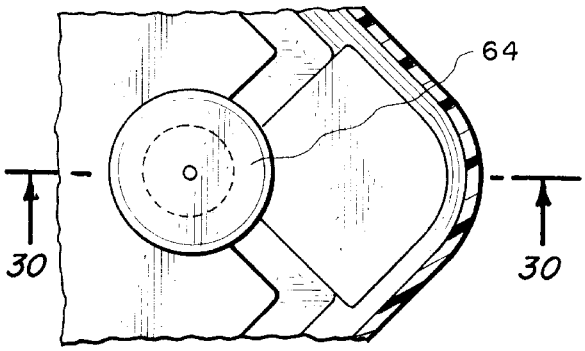
FIG. 29 is also similar to FIG. 9, but illustrates still another of the many alternative embodiments of the invention (showing the use of an upper plug member over the drainage hole)
Figure 30:
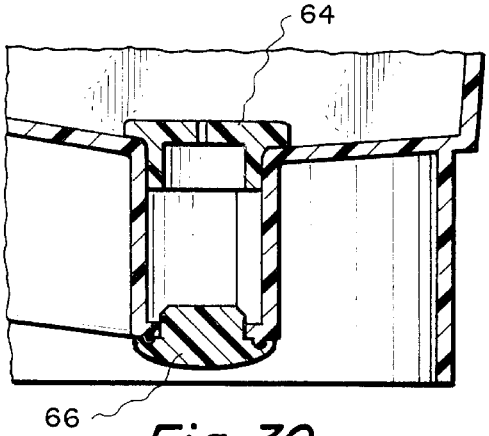
FIG. 30 is a sectional view taken along line 30—30 of FIG. 29.

As indicated above, the container and the components thereof can be provided in a variety of configurations. By way of example and not by way of limitation, some of the many alternative embodiments of the drainage means of our invention are illustrated in FIGS. 12–17 and FIGS. 27–30. The opening can be covered by a shelf portion 44, FIGS. 12 and 13; can be provided in various shapes such as a curvilinear strip 46, FIGS. 14 and 15; and can be provided with a cap portion 48 over the opening, FIGS. 16 and 17. As illustrated in FIGS. 27–28, the drainage hole 62 can be positioned away from the periphery of the container by the provision of channel portions 60. The roe may also or alternatively be supported by an upper plug 64, FIGS. 29–30, preferably positioned over the lower plug 66.

Among other things, these embodiments of FIGS. 12–17 and FIGS. 27–30 provide additional support for the slurry adjacent the drainage opening. This can be especially beneficial, for example, if mechanical pressure if applied to the upper portion of the slurry in the container 20 (such as by pressing on the lid 28) to squeeze liquid from the slurry 37. The additional support provided by embodiments such as FIGS. 12–17 and FIGS. 27–30 helps ensure that the slurry and/or the particulate matter thereof will not be undesirably forced from the container 20 out the opening 32 (such as might otherwise occur prior to insertion of the plug means in the opening 32).

The container of our invention can alternatively be utilized, FIGS. 18–21, with a separate central elevating platform member 50 similar to prior art elevating members (see member 18, FIGS. 1–4). This provides an additional degree of spacing (and consequent drainage differential) between the bottom of the slurry and the drainage hole in the sluice channel. As with prior art devices, ti elevating member 50 preferably has a normally relatively upwardly positioned central portion 52 and peripheral skirt means 54 extending downwardly therefrom. In the preferred alternative of the present invention, however, the skirt means 54 is disposed in is the sluice channel.

Figure 23:
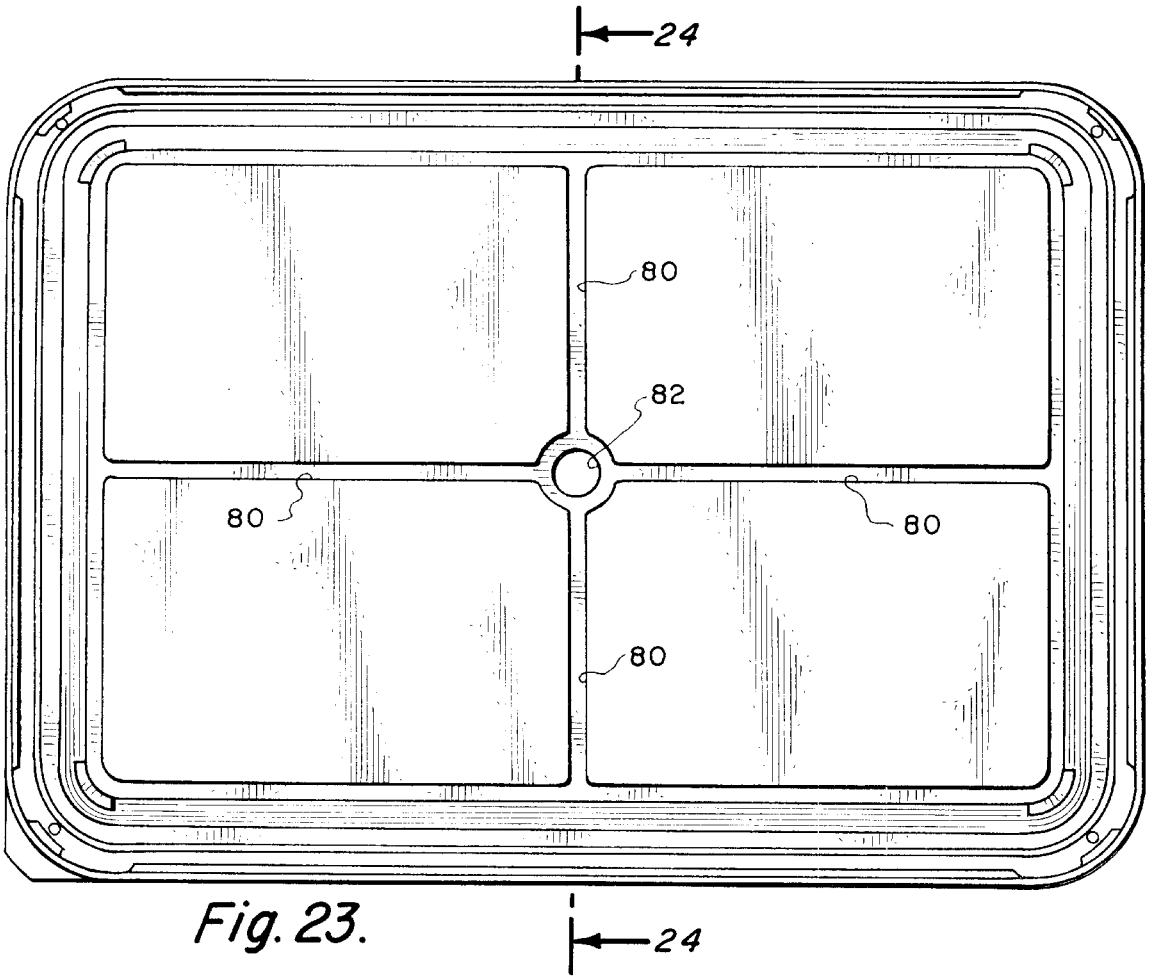
FIG. 23 is similar to FIG. 5, but illustrates one of the many alternative embodiments of the invention (showing a different pattern of drainage channel and a central location of the drainage hole)
Figure 24:
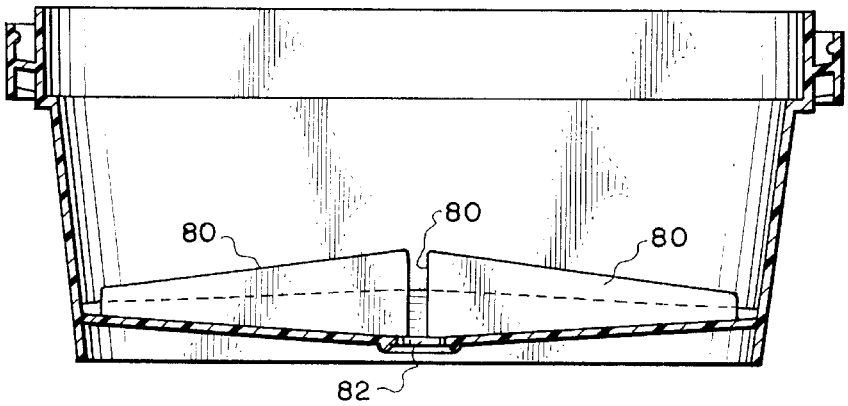
FIG. 24 is a sectional view taken along line 24—24 of FIG. 23.

FIGS. 23 and 24 illustrate one of the many variations of the drainage channel of the invention. In addition to a drainage channel at the periphery of the container bottom, non-peripheral channel portions 80 are provided and are sloped to urge liquid toward a non-peripherally located drainage hole 82. Persons of ordinary skill in the art will understand that the drainage hole 82 can be located at any suitable location on the base of the container, and that the drainage channels 80 are preferably provided to urge liquid to that drainage hole location.

The non-peripheral drainage channels 80 can be utilized without any peripheral drainage channels. Persons of ordinary skill in the art will understand that, in such an embodiment, the liner means preferably be modified to permit drainage from above the liner to the drainage channel, by providing some passage through the liner (such as a slot or hole) immediately above the non-peripheral drainage channel.

Figure 25:
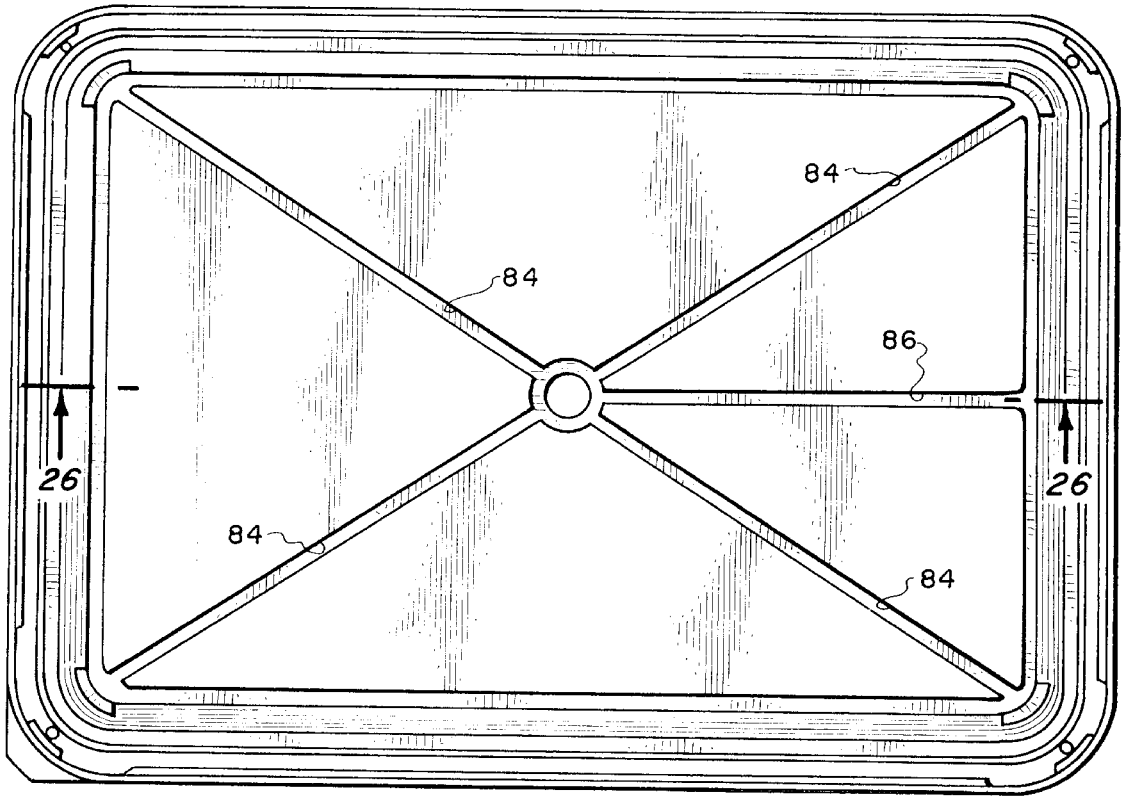
FIG. 25 is also similar to FIG. 5, but illustrates another of the many alternative embodiments of the invention (showing yet a different pattern of drainage channel)
Figure 26:
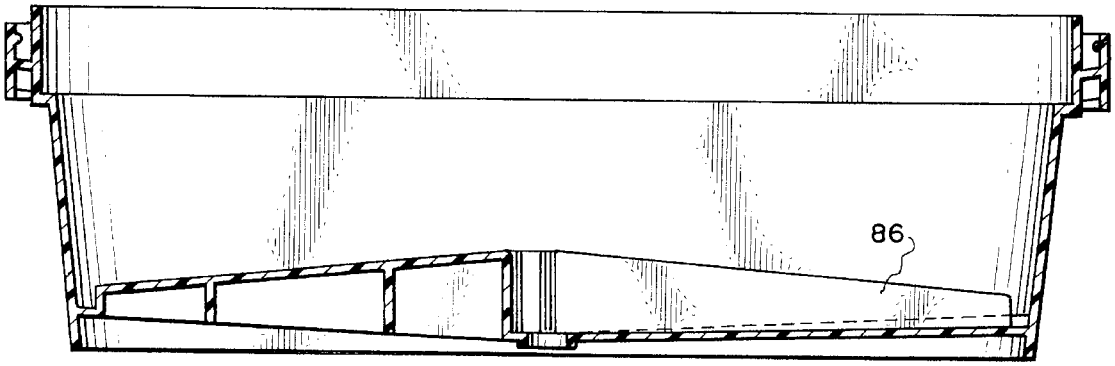
FIG. 26 is a sectional view taken along line 26—26 of FIG. 25.

FIGS. 25 and 26 illustrate another of the many variations of the drainage channel of the invention. As with the embodiment of FIGS. 23 and 24, non-peripheral channel portions 884 and 86 are provided and are sloped to urge liquid toward a non-peripherally located drainage hole. The channels 84 are preferably positioned and configured to drain from the corners of the container, so that the liner of FIG. 31 or FIG. 10 can be utilized without modification (because those liners are configured at those corners to allow the liquid can pass at those corners from above the liner to below the liner; see slots 74 of FIG. 31, for example). Persons of ordinary skill in the art will also understand that (as with the embodiment of FIGS. 23 and 24) the non-peripheral drainage channels 84 and 86 can be utilized without any peripheral drainage channels and that the channels can be provided in a wide variety of combinations and orientations. Among other things, the non-peripheral drainage channels can be positioned at other than the corners or the middle of the container sides.

Figure 31:
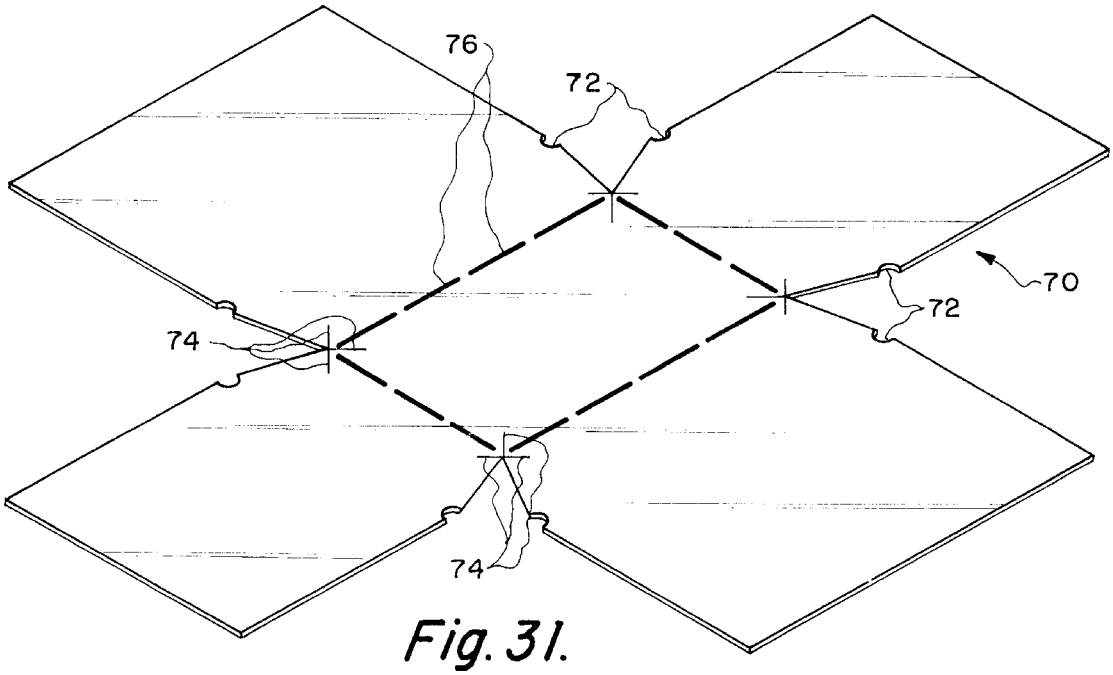
FIG. 31 is an perspective view of one of the many alternative embodiments of a liner useful to place beneath the roe slurry.

One of the many alternative embodiments of the liner is illustrated in FIG. 31, as liner 70. Among the useful features which may be incorporated into the liner 70 are rounded corners 72. Although the rounded corners 72 are only shown on some of the corners of the liner 70, such rounding may be provided on others or all of the corners, which may reduce the likelihood of tearing at those locations.

Other liner features include "pre-cut" slots 74 at the innermost corners of the liner 72, which slots 74 also reduce the likelihood of tearing at those locations and improve the drainage of liquid from above the liner to the drainage channel. Absent those slots 74 or some equivalent, the interior corner would have to be more precisely positioned within the container to ensure that most of the liquid was permitted to drain into the drainage channel.

Another liner feature illustrated in FIG. 31 is the provision of guide means 76 to help appropriately position the plastic liner 70 within a container. Absent such guide lines 76, it be more difficult to achieve an acceptable positioning. In the preferred embodiment of these guide lines 76, colored lines are provided on the liner along the axes of bending of the liner, where the liner 70 will be bent to abut the junction of the container bottom with the container sidewalls.

A preferred method of our invention is useful for transporting fish roe or other materials requiring draining of liquid therefrom. It includes the steps of providing a container having a base portion and an upwardly extending sidewall portion, with the base portion including a roe-supporting portion and a sluice channel formed integrally with the particulate-supporting portion. As discussed above, the channel is configured to receive liquid from the slurry when the container is in its normally upright position. Additional steps of the preferred method include placing a slurry of fish roe into the container, scaling the container (such as by use of a lid member), and transporting the container.

Further steps include providing a drainage opening in the channel, with the channel configured to urge the liquid from the slurry toward the drainage opening, and allowing liquid to drain from the slurry through the opening and subsequently plugging the opening to prevent further drainage. Other steps include placing a central elevating member into the container before placing the slurry of fish roe into the container. As indicated above, this elevates the slurry with respect to the channel and can, among other things, improve the drainage of liquid therefrom. A liner can also be placed in the container prior to placing the slurry of fish roe into the container, as part of the method of our invention.

Thus, by our invention, we provide an improved container and method for transportation, processing, and/or storage of particulate materials or other materials which require some drainage of liquid therefrom. Persons of ordinary skill in the art will understand that, in addition to being usable with slurries of relatively small particles, our invention may have utility with larger particles, even those which might approach the size of the container itself.

The apparatus and method of our invention have been described with some particularity but the specific designs, constructions and steps disclosed are not to be taken as delimiting of the invention in that various modifications will at once make themselves apparent to those of ordinary skill in the art, all of which will not depart from the essence of the invention and all such changes and modifications are intended to be encompassed within the appended claims.

We claim:

1. A container for particulate matter which matter is initially in a slurry, including a base portion and a sidewall portion extending upwardly therefrom when said container is in its normally upright position, said base portion including a particulate-supporting portion and a sluice channel formed integrally with said particulate-supporting portion, said channel being configured to receive liquid from the slurry when said container is in its normally upright position; said particulate-supporting portion being sloped toward said sluice channel to urge fluid to drain from the slurry into said channel, and said sluice channel including a bottom portion capable of directing the liquid toward a drainage opening therethrough, wherein at least a portion of said channel is not at the periphery of said base portion, said bottom portion constituting a surface having a point relatively highest above said drainage opening when said container is in its normally upright position, and said bottom portion of said channel having a substantially continuous downward gradient along said bottom portion from said point toward said drainage opening when said container is in its normally upright position, wherein said container has at least one corner when viewed in plan view and said channel extends downwardly from said corner to said drainage opening.

2. The container of claim 1, in which said drainage opening is adjacent said sidewall portion of said container.

3. The container of claim 1 or claim 2, further including a separate platform member having a normally relatively upwardly positioned central portion and spacing means extending downwardly therefrom to space said central portion from said base portion.

4. The container of claim 3, in which said separate platform member is capable of being contained within said container without said platform member being deformed or destroyed.

5. The container of claim 1 or claim 2, further including liner means overlying said channel to help prevent the particulate matter from falling into said sluice channel when said container is in its normally upright position.

6. The container of claim 1 or claim 2, in which said particulate-supporting portion constitutes a majority of said base portion.

7. The container of claim 1 or claim 2, in which the width of said particulate-supporting portion in a given direction is at least twice the width of the combined width of said sluice channel in the same direction.

8. A plastic, injection-molded container and associated lid for transporting fish roe which is initially in a slurry, said container having a bottom and a sidewall portion extending upwardly therefrom and defining an opening coverable by said lid, said bottom including a downwardly extending drainage channel formed integrally with said bottom, said channel having a drainage opening at a normally lowest point therein, said bottom configured to urge liquid from said slurry toward said channel, and said channel configured to urge the liquid toward said drainage opening, said urging configuration of said channel including a bottom portion thereof constituting a surface having one or more points relatively highest above said drainage opening when said container is in its normally upright position, and said bottom portion of said channel having a substantially continuous downward gradient along said bottom portion from said one or more points relatively highest above said drain opening toward said drainage opening when said container is in its normally upright position, wherein at least a portion of said channel is not at the periphery of said base portion, wherein said container has at least one corner when viewed in plan view and said channel extends downwardly from said corner to said drainage opening.

9. The container and lid combination of claim 8, further including plug means for plugging said drainage opening after liquid has drained therefrom.

10. A plastic, injection-molded container and associated lid for transporting fish roe which is initially in a slurry, said container having a bottom and a sidewall portion extending upwardly therefrom and defining an opening coverable by said lid, said bottom including a downwardly extending drainage channel formed integrally with said bottom, said channel having a drainage opening at a normally lowest point therein, said bottom configured to urge liquid from said slurry toward said channel, and said channel configured to urge the liquid toward said drainage opening, said channel including sidewalls that are substantially vertical when said container is in its normally upright position, wherein at least a portion of said channel is not at the periphery of said base portion, further including a supplemental central elevating member having a central portion including one or more surfaces sloped toward said channel and a skirt portion extending normally downwardly therefrom, said skirt configured to interfit into said channel.

11. A plastic, injection-molded container and associated lid for transporting fish roe which is initially in a slurry, said container having a bottom and a sidewall portion extending upwardly therefrom and defining an opening coverable by said lid, said bottom including a downwardly extending drainage channel formed integrally with said bottom, said channel having a drainage opening at a normally lowest point therein, said bottom configured to urge liquid from said slurry toward said channel, and said channel configured to urge the liquid toward said drainage opening, said channel including sidewalls that are substantially vertical when said container is in its normally upright position, wherein at least a portion of said channel is not at the periphery of said base portion, further including plug means for plugging said drainage opening after liquid has drained therefrom, further including a supplemental central elevating member having a central portion including one or more surfaces sloped toward said channel and a skirt portion extending normally downwardly therefrom, said skirt configured to interfit into said channel.

12. The container and lid combination of claim 10 or claim 11, said channel having substantially vertical opposing side portions and a bottom portion sloped from a relatively higher point toward said normally lowest point.

* * * * *